United States Patent [19]

Rawcliffe

[11] Patent Number: 4,844,055

[45] Date of Patent: Jul. 4, 1989

[54] PHYSIOTHERAPY APPARATUS

[76] Inventor: John Rawcliffe, 11 Rutland Avenue, Atherton, Manchester M29 9HN, England

[21] Appl. No.: 852,616

[22] Filed: Apr. 16, 1986

[30] Foreign Application Priority Data

Apr. 18, 1985 [GB] United Kingdom ..... 8509968

[51] Int. Cl.[4] ..... A63B 23/04

[52] U.S. Cl. ..... 128/25 R; 272/125

[58] Field of Search ..... 128/25 R, 25 B; 272/DIG. 5, DIG. 6, 129–134, 73, 125; 273/1 G, 1 C, 1 GE

[56] References Cited

U.S. PATENT DOCUMENTS

| | | | |
|---|---|---|---|
| 3,465,592 | 9/1969 | Perrine . | |
| 3,735,101 | 5/1973 | Stewart | 272/129 |
| 3,869,121 | 3/1975 | Flavell | 272/129 |
| 3,929,335 | 12/1975 | Malick | 272/129 |
| 3,973,251 | 8/1976 | Stephas | 272/73 |
| 4,184,678 | 1/1980 | Flavell et al. | 272/129 |
| 4,333,340 | 6/1982 | Elmeskog . | |
| 4,408,183 | 10/1983 | Wills | 272/DIG. 6 |
| 4,462,252 | 7/1984 | Smidt et al. . | |
| 4,565,366 | 1/1986 | Struss | 272/DIG. 5 |
| 4,678,184 | 7/1987 | Nieger et al. | 272/129 |
| 4,711,450 | 12/1987 | McArthur | 272/DIG. 5 |

FOREIGN PATENT DOCUMENTS

| | | |
|---|---|---|
| 0057609 | 11/1982 | European Pat. Off. . |
| 083568A | 7/1983 | European Pat. Off. . |
| 016094B | 6/1984 | European Pat. Off. . |
| 155629A | 9/1985 | European Pat. Off. . |
| 057609B | 11/1985 | European Pat. Off. . |
| 8203228 | 3/1984 | Netherlands . |

*Primary Examiner*—Leo P. Picard

*Attorney, Agent, or Firm*—Richard E. Jenkins

[57] ABSTRACT

The invention provides apparatus for use by a physiotherapist, for measuring the force exerted by a patient, and for exercising a patient, particularly in a rehabilitation program. The apparatus is of the kind wherein the patient is required to exert a force against resistance beam arrangement and in the first aspect of the invention, there is a preset rest duration indicator which is adapted to issue a "countdown" signal to the patient up to a predetermined starting time at which the patient is required to exert force against the beam. This feature avoids the patient jerking a limb or body part when a force is required to be exerted against the beam.

Another feature of the invention is that the indicator includes a graphic display device which has a presetable target force display. Hence the patient is able to obtain a visual indication as to when the force he is applying is equal to the target force.

A third aspect of the invention relates to the provision of force duration indication means adapted to give a signal only so long as a force at least equal to the preselected target force is exerted on the beam and rest duration indicator adapted to give a signal of predetermined duration indicating the length of a required rest period between muscular contractions of the patient.

Finally, the invention includes a beam arrangement forming part of the resistance means, which incorporates a tubular part and a portion of reduced second moment of area at which strain gauges detect deflection of the beam under an applied force.

6 Claims, 13 Drawing Sheets

Figure 1:
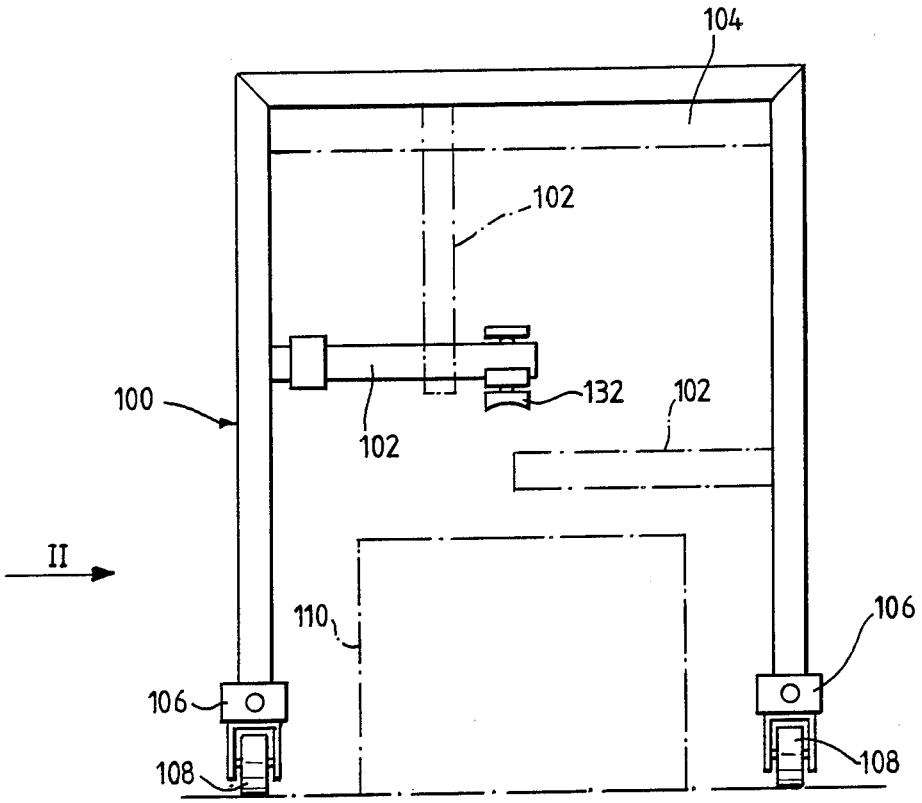

FLIP-FLOP
(COMMUTATOR)
228
230
Q
Q̄
AND
232
216
224
218
220
226
222
210
234
212
214
B'T
B'S
A'T
A'S
DT
DS
CT
CS
BT
BS
AT
AS
B'
A'
D
C
B
A
16'
16
B.C.D. LINES FROM A/D CONVERTERS 12 AND 12'
B.C.D. LINES FROM "TARGET FORCE" SWITCHES 13 AND 13'

PHYSIOTHERAPY APPARATUS

A well known method of rehabilitating defective musculature in a patient requires the patient to voluntarily contract and relax the defective muscle group against an applied load. Generally, the physiotherapist will prescribe the applied load, and an exercise programme requiring a specified number of muscular contractions and relaxations. Ideally, the programme should also specify the duration of the voluntary contraction against the applied load.

The level of the load which provides the force opposing the force exerted by the patient in contracting the muscle group, is set or prescribed by the physiotherapist, after measurement of the maximum voluntary contraction of the defective muscle group. For instance, the force required to be exerted by the patient in a physiotherapy programme may be about half the measured maximum voluntary contraction force. Sometimes, the calculation of the load for the physiotherapy programme, requires the measurement of the maximum voluntary contraction of the limb which does not require treatment. For example, if one leg has sustained damage to the musculature, the maximum voluntary contraction may be measured on the other leg. However, this can in itself provide a variable, because during physiotherapy, sometimes the undamaged limb is also exercised, resulting in an increasing maximum voluntary contraction of that limb.

Methods of measuring the maximum voluntary contraction can be illustrated, by considering the specific case of the rehabilitation of the quadriceps, following defects of the knee joint and/or lower limb. In a first method, frequently used in physiotherapy departments, bags containing known weights of sand are slung from the lower end of the patient's tibia, and the patient is instructed to raise the lower limb against the applied force. Initially of course, the person carrying out the test has to make an estimate of the load which can be applied, and generally speaking, this will be underestimated at the commencement of the test, and then the load gradually increased by the use of bags containing greater weights of sand. It will be appreciated that this method is crude both in appearance and accuracy.

A second method of measuring the maximum voluntary contraction, which is available in some physiotherapy departments, requires the patient to wear a so-called Delorme boot, which is a boot of special construction, to which metal weights of known value can be attached. This is little improvement on the sand bag method.

Using either of these known methods, the physiotherapist attempts to measure the maximum voluntary contraction of the patient by an iterative or trial-and-error process, involving several, and in some cases, many, combinations of applied weights, until that combination is found which matches the maximum voluntary contraction of the patient. Once this is known, the physiotherapist is then in a position to calculate a target force for the exercise programme. The programme itself will then normally consist of repetitious elevations of the lower limb, with the sand bags resting on or suspended from the tibia, or the weights attached to the Delorme boot worn by the patient. Each time the patient raises the lower limb, he must voluntarily contract the musculature of that limb, and when the limb is lowered, the muscles are relaxed.

Physiotherapists believe that if the target exercise force is under prescribed, the time required to full recovery of the defective muscle group is increased. It has been shown that the maximum voluntary contraction, on which the prescribed target load is calculated, is almost always measured in defect of its true value, and in some cases, the defect is very large indeed. It is quite obvious that measurement of the maximum voluntary contraction is virtually never made in excess, for the simple reason, that the patient is incapable of lifting a load in excess of the maximum voluntary contraction force. Consequently, errors tend to reduce the measured maximum voluntary contraction force.

There are two main factors contributing to the error in maximum voluntary contraction force determinations. One of these is that after a number of iterative tests, in order to estimate the maximum voluntary contraction force, the patient becomes tired, and this reduces the measured maximum voluntary contraction. The second factor contributing to error applies when sand bags are used, and is caused by imprecise location of the sand bags on the tibia. Obviously, the force which the patient has to exert by using the leg muscles, is reduced, if the turning moment applied by the sand bags is reduced because the sand bags are located nearer to the knee. A similar location problem arises if more sophisticated hand-held measuring apparatus is used.

Another factor which can give rise to error in the measurement of the maximum voluntary contraction or incorrect prescription of exercise force is that the limb of the patient may be inclined (or extended) at differing angles. The force which can be exerted by a patient varies with the angle at extension partcularly from 0° to 15° extension (which is the range in which the sand bag method is used). Consequently, the traditional measuring techniques are subject to error because of imprecise setting of the angle of extension. For instance, if the patient is seated, with the tibia extended at an angle of 45° to the horizontal, the force required to be exerted by the muscles in order to lift a given load applied by the use of a Delorme boot, will be appreciable less than the force which is required to be exerted when the tibia is extended almost horizontally.

Yet another problem associated with the measurement of maximum voluntary contraction force in the muscles of a patient, is the incidence of arthritis in related joints. The pain experiences by the patient in the necessary movement required to lift the sand bags or Delrome boot, may outweigh any limitation due to defective muscles strength, so that the measured maximum voluntary contraction may be well below that of which the muscles are capable, were it not for the overriding arthritic pain factor.

Incorrect measurement of the maximum voluntary contraction of a patient is probably the major factor in slowing the recovery of patients required to undergo physiotherapy for muscular rehabilitation. There are however other factors which detract from the value of the rehabilitation procedure. One of these is that the physiotherapist will normally require the patient to exert the force for a prescribed period, at each msucular contraction. This therefore requires extra time from the staff in order to teach the patient how to exercise at the correct rate of contraction. Further, the presence of an assistant may be required, in order to ensure that the patient fulfills the required number of contractions and relaxations specified by the physiotherapist at any one session.

It is one of the objects of the present invention to provide an apparatus which can be used for measuring the maximum voluntary contraction force of a patient more accurately than the known methods referred to above. Another object is to provide physiotherapy apparatus, which gives a better control over an exercise programme prescribed by a physiotherapist for muscular rehabilitation. Other objects of the invention include the provision of physiotherapy apparatus which results in a bio-feedback which provides motivation for the patient which is especially important when exercise is painful, e.g. where arthritic conditions are prevalent.

Apparatus is known for measuring the muscular force exerted by a patient and for exercising a patient which comprises: a beam having a location to abut a part of the patient's body which can be moved by muscular contraction, whereby a bending force related to the strength of the muscular contraction can be applied to the beam; a transducer for converting sensed deflection of the beam into an output signal related to the applied bending force, and an indicator adapted to be actuated by the output signal to give an indication of the strength of the force applied to the beam and therefore an indication of the strength of the muscular contraction. It will be appreciated, that it should be possible to obtain very accurate measurement of the force applied by muscular contraction, when deflection of a beam is utilised, since such deflection is highly consistent within the linear elastic range of the beam.

Exercising apparatus has been proposed which can be pre-programmed so as to indicate the duration of rest periods to the patient, so that the patient can relax the muscle group so long as the rest period is indicated and then contract the muscle group when the force period is indicated. Typically the indication may be by means of illuminated lamps and at the end of a rest period, the rest lamp is extinguished and the force lamp illuminated. (It will be appreciated that indicators other than lamps could be employed.) A problem which has not previously been recognized is that if the patient has no advance warning of when the end of the rest period will be signalled, there is a tendency for the patient to jerk the limb of body part in response to the appearance of the signal and this is generally undesirable in a rehabilitation programme. In certain cases it will cause physical pain. Moreover, the tension created by waiting for the signal can also detrimental.

According to a first aspect of the invention exercising apparatus includes resistance means for resisting a force applied by a patient contracting muscles associated with a limb or body part pressed against the resistance means and a preset duration indication means is provided, this rest duration indication means being adapted to issue a "count-down" signal up to a predetermined starting time at which the patient is required to exert force against the resistance means.

Preferably the rest duration indication means comprises a graphic display. The rest duration indication means may comprise a series of lamps adapted to be illuminated or extinguished in series to provide the "count-down" signal.

Another aspect of the invention is concerned with motivating the patient to carry out an exercise programme. According to this aspect of the invention exercising apparatus includes resistance means for resisting a force applied by a patient contracting muscles associated with a limb or body part pressed against the resistance means and a graphic display device adapted to give an indication of the force applied against the resistance means, the graphic display device including in itself a presetable target force display. In the preferred construction the graphic display comprises a series of indicia each corresponding to a predetermined applied force, so that as the applied force is increased, the indicia are successively activated and de-activated along the length of the series. Preferably, the indicia are lamps arranged as a moving dot display, anyone of which can be separately activated to indicate the target force. It is further preferred that the apparatus includes manually operable means activating a selected indicia to give an indication of a target applied force corresponding to the force required to cause activation of that indicia by the output signal from the transducer.

Yet another aspect of the invention is concerned with providing an exercise programme for a patient which does not require the presence of a physiotherapist or nurse. According to this aspect of the invention exercising apparatus includes resistance means for resisting a force applied by a patient contracting muscles associated with a limb or body part pressed against the resistance means and an indicator adapted to give an indication of force applied by the patient to the resistance means; the apparatus including manually adjustable force duration indication means adapted to give a signal so long, and only so long, as a force at least equal to the preselected target force is exerted on the resistance means and rest duration indication means adapted to give a signal of predetermined duration indicating the length of a required rest period between muscular contractions of the patient.

A further aspect of the invention is concerned with the provision of rehabilitation apparatus of the known type previously referred to, which is adapted for isometric exercise by the patient, that is to say, exercise which involves very little or no movement of the patient's limb or body part.

According to this aspect of the invention apparatus for measuring the muscular force exerted by a patient and/or for exercising a patient comprise a beam having a location to abut a part of the patient's body which can be moved by muscular contraction, whereby a bending force related to the strength of the muscular contraction can be applied to the beam; a transducer for converting sensed deflection of the beam into an output signal related to the applied bending force, and an indicator adapted to be actuated by the output signal to give an indication of the strength of the force applied to the beam and therefore an indication of the strength of the muscular contraction, the beam being carried cantilever fashion by a relatively massive support structure such that force exerted by muscular contraction of the patient produces no significant movement of the support structure, the beam comprising a tubular portion and a part of reduced second moment of area to permit concentration of bending of the beam at the portion of reduced second moment of area and to minimise movement of the beam required to produce an adequate transducer output signal, and a cuff mounted on the tubular part of the beam for engagement with the limb or other body part of the patient.

Preferably, provision is made for mounting the cuff at different positions along the length of the beam.

In a preferred construction, the transducer comprises one or more strain gauges applied to the part of reduced moment of inertia, the strain gauges being adapted to give an electrical output signal which is directly related to the deflection of the beam. Preferably, the part of the beam of reduced moment of inertia is shrouded. This construction gives the beam a high degree of sensitivity to applied bending forces, combined with a low overall deflection.

The cuff may be angularly adjustable about the longitudinal axis of the beam, and it may also be angularly adjustable about a diametral axis of the beam. Adjustment about the longitudinal axis is preferably provided by making the entire beam adjustable on its mounting. The cuff provides a comfortable location for the part of the patient's body which has to exert the force against the beam, and if it is adjustably mounted in accordance with the preferred features mentioned above, then it can be accommodated to a particular patient, and to a specific extension (i.e. angular disposition) of the patient's limb.

In a preferred construction, the support structure comprises a gantry adapted to be located over a bed or like patient support, and the beam extends transversely of the gantry. In the preferred arrangement, the gantry provides at least two positions at which the beam can be mounted. Moreover, there may be provision for vertical as well as horizontal mounting of the beam. It is further preferred, that the beam is constructed so that its bending or deflection in response to an applied force created by muscular contraction of the patient is imperceptible to the human eye and the transducer is adapted to provide an electrical output signal, the indicator including electronic means for converting the output signal into a display.

It is further preferred that the indicator includes an analogue to digital converter so that the output signal appears in digital form at the input to the indicator.

Preferably, the means for counting down the number of repetitions is so arranged that it will only reduce one digit within each force duration period. This will prevent the patient obtaining credit for more than one muscular contraction during a single force duration period.

In the preferred construction, the moving dot display is utilised to give an indication of the force applied and also an indication of the target force. A method of achieving this, is to arrange for gating of two separate input signal sources, one controlling the illumination of a lamp of the display at a frequency such that persistence of vision gives the impression that the lamp is continuously illuminated, and the other at a frequency which produces a flashing effect, the one input being associated with the applied force signal and the other being associated with the target force signal, the gating ensuring that activating voltage is only "on" to the target selecting input during "off" periods of the applied force activating voltage. In other words, the invention provides a multiplexer for the force applied and a target indicator using the principle of gating the multiplexer to produce the two separate signals on the one set of display lamps.

Figure 3:
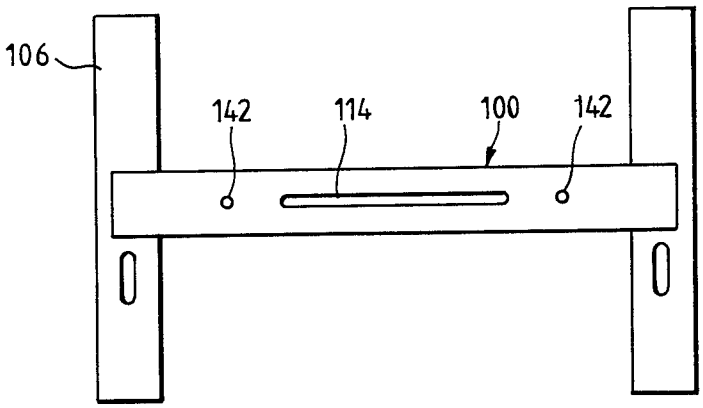
Figure 2:
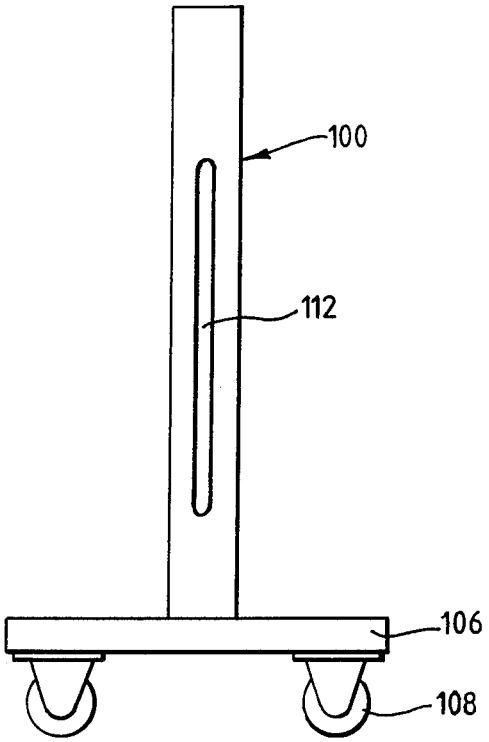
Figure 4:
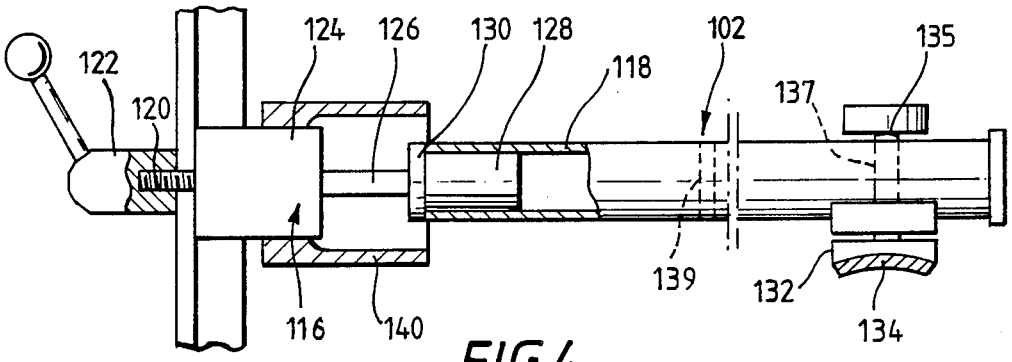
Figures 5, 6:
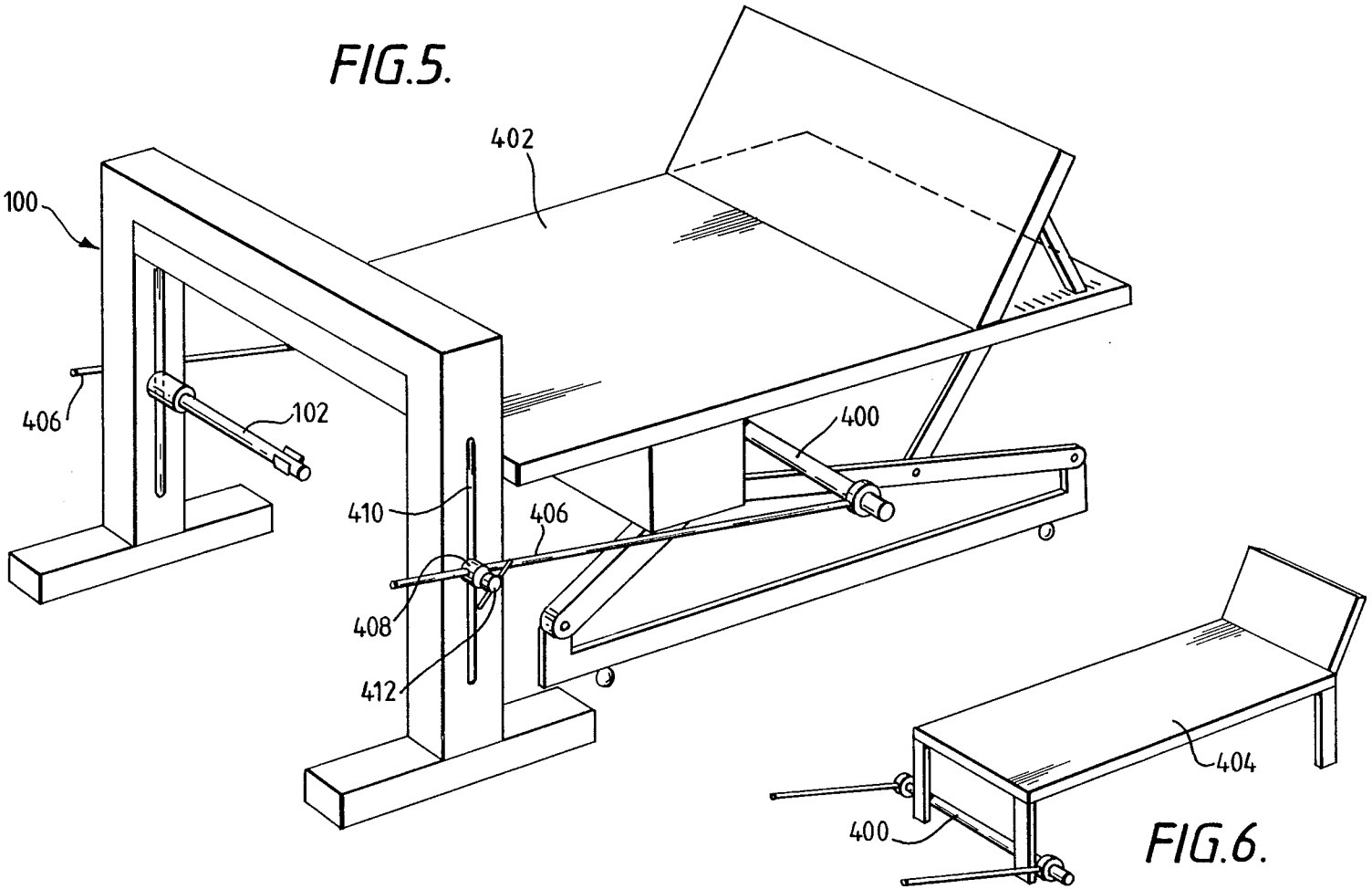
Figure 7:
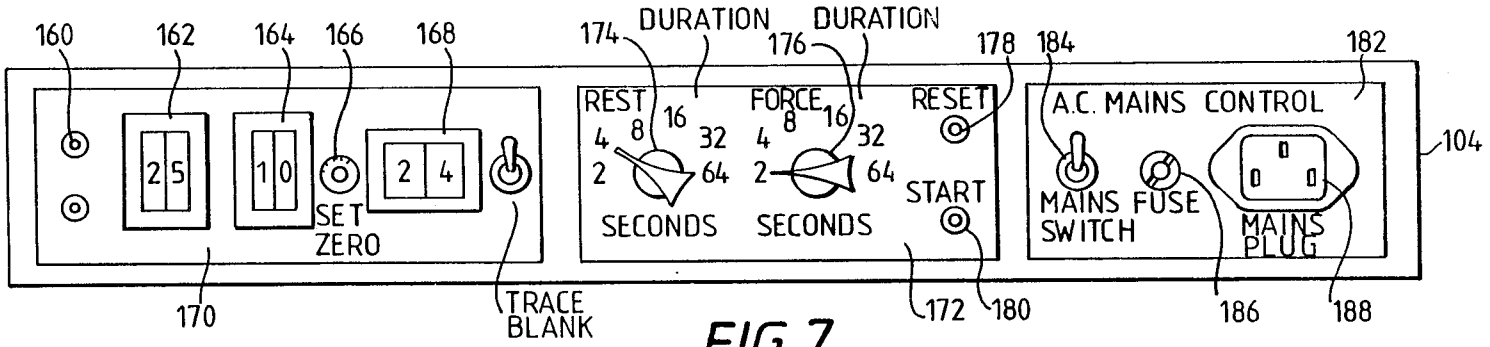
Figure 8:
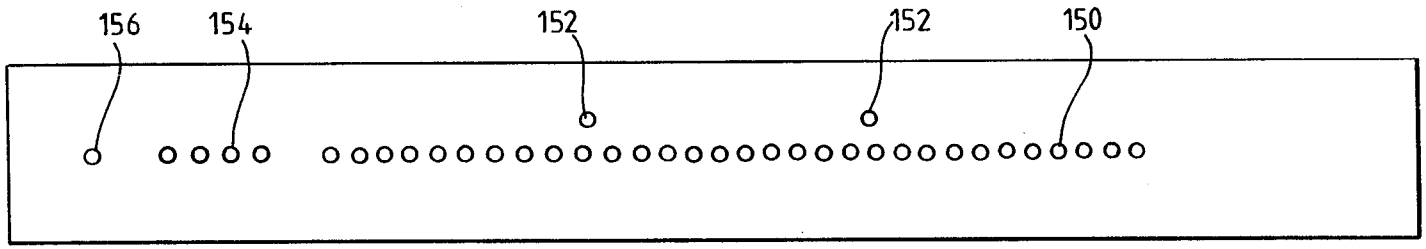
Figure 9:
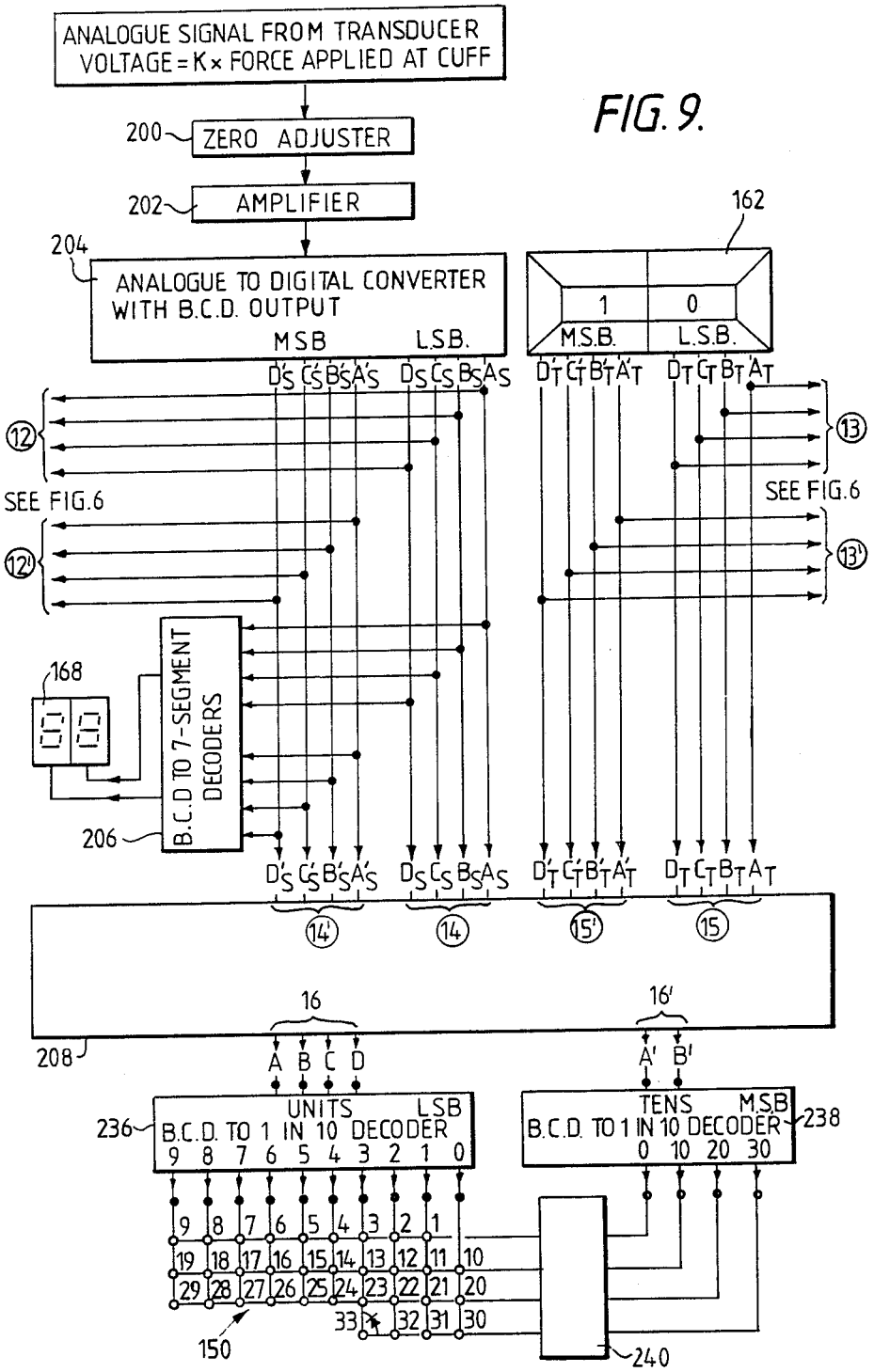

Other preferred features of the invention, will appear from the following description of a physiotherapy apparatus in accordance with the invention, and its method of use, which will now be described by way of examples only, with reference to the accompanying drawings, in which:

FIG. 1 is a front view of an apparatus for measuring muscular contraction and for muscular exercise, FIG. 2 is an end view looking in the direction of arrow II in FIG. 1, FIG. 3 is a plan view of the apparatus shown in FIG. 1, FIG. 4 is an elevation partly in section of a beam used in the apparatus, FIG. 5 is a perspective view showing the apparatus combined with a plinth having an elevation mechanism, FIG. 6 is a perspective view showing the apparatus combined with a conventional plinth, FIG. 7 is a view on the rear side of electronic control and display apparatus, FIG. 8 is a view on the front side of the control and display apparatus shown in FIG. 7, FIG. 9 is a block diagram of electronic apparatus for a moving dot display, and display of achieved force.

Figure 10:
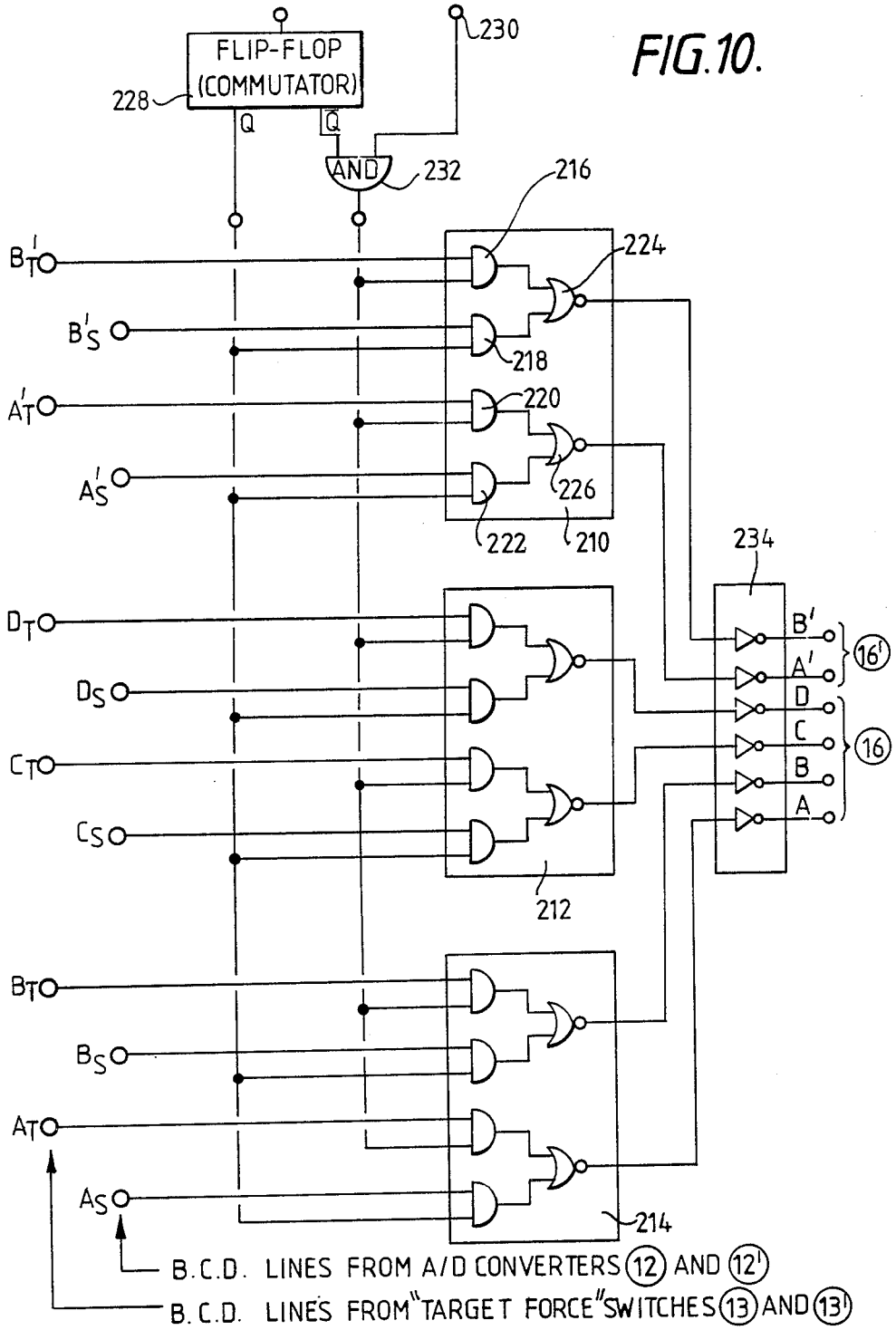
Figure 11:
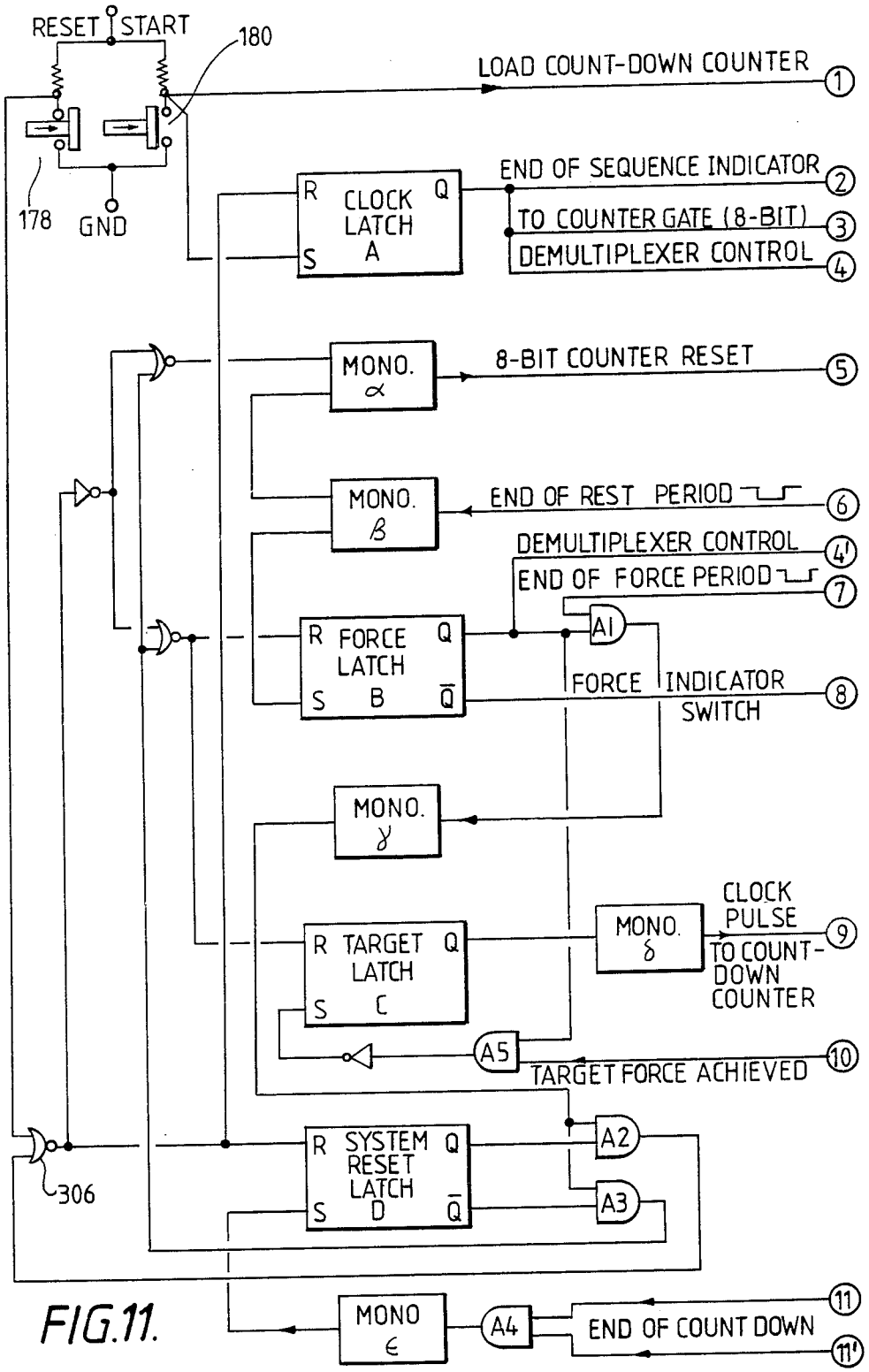
Figure 12:
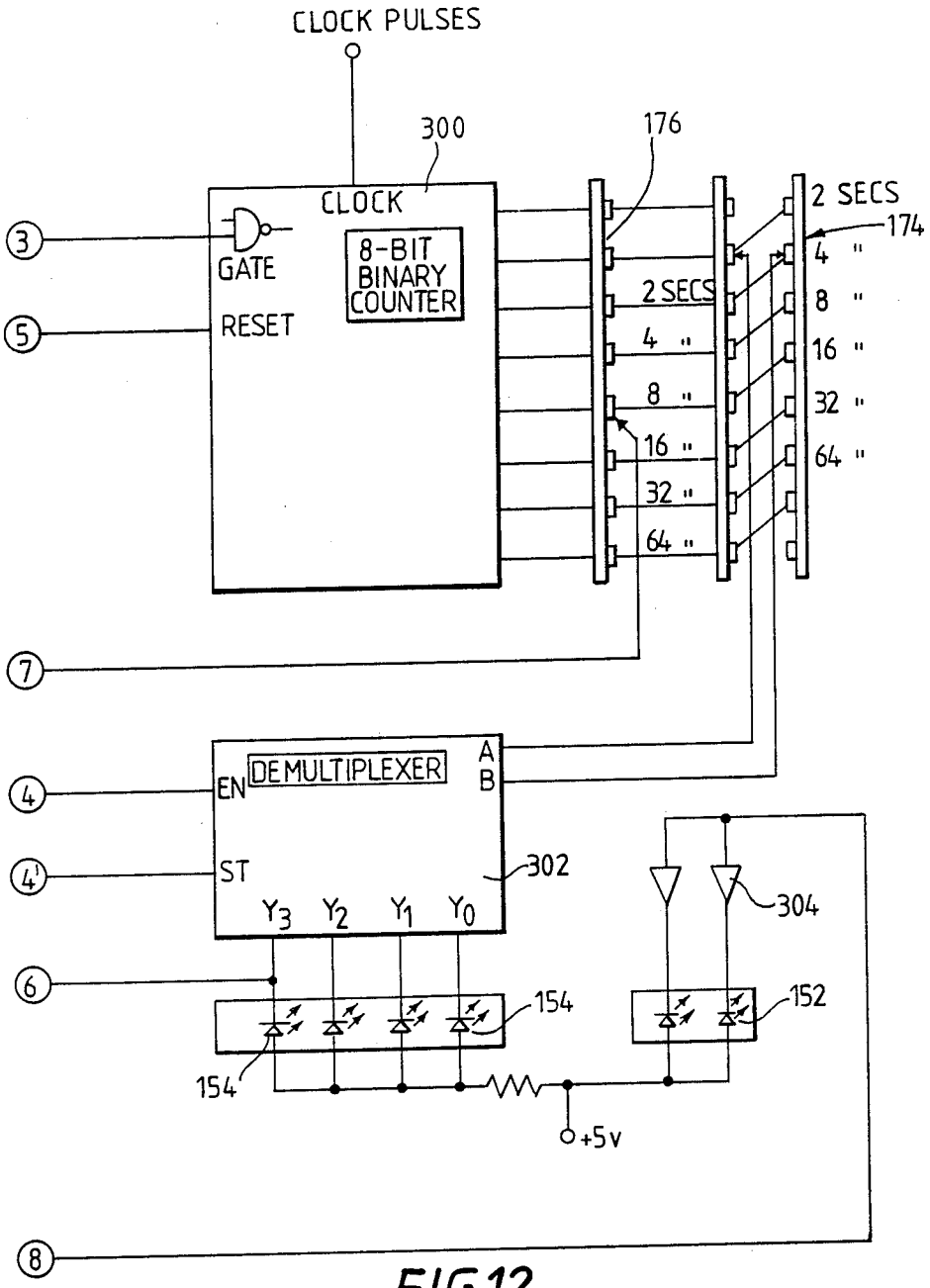
Figure 13:
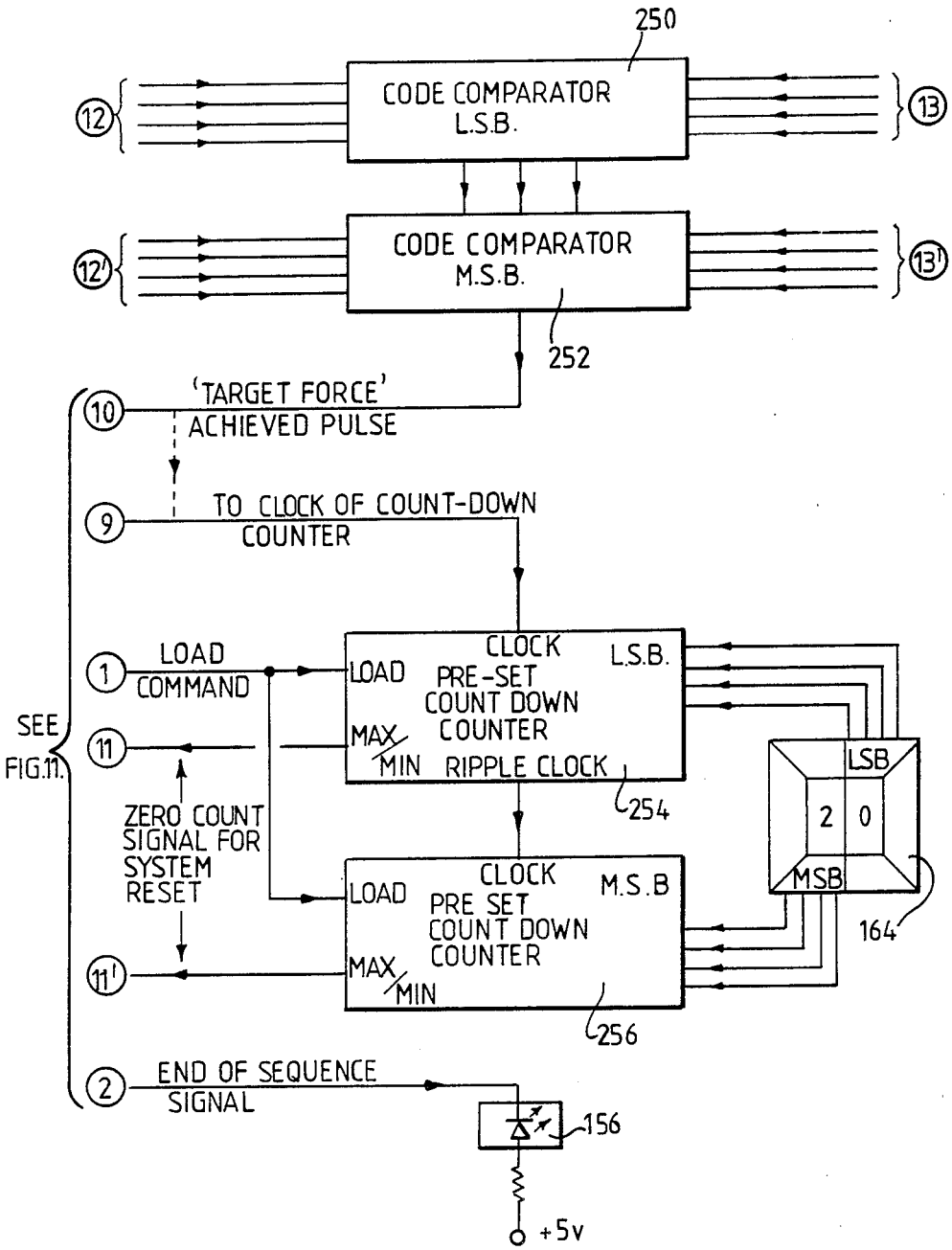
Figure 14:
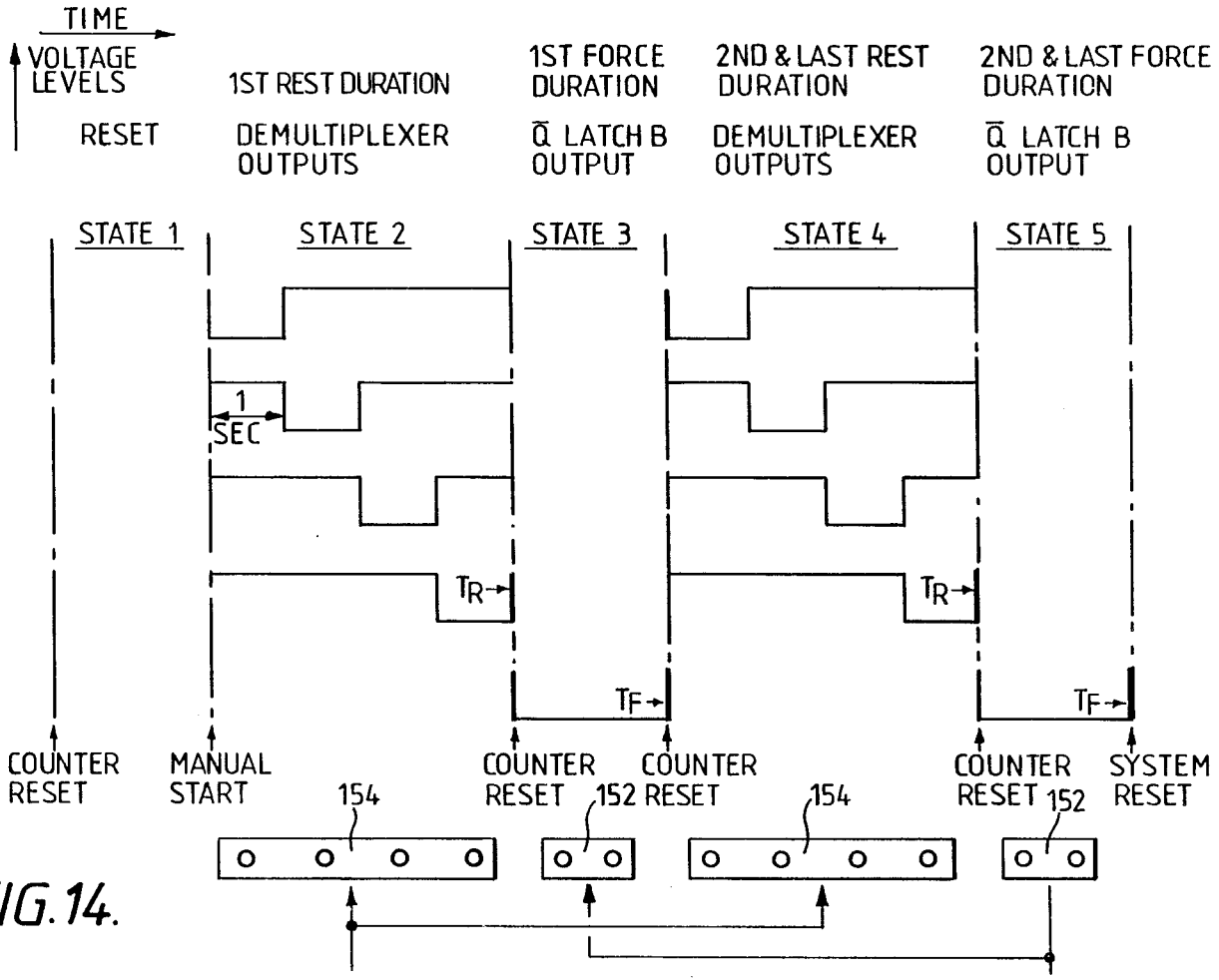
Figure 15:
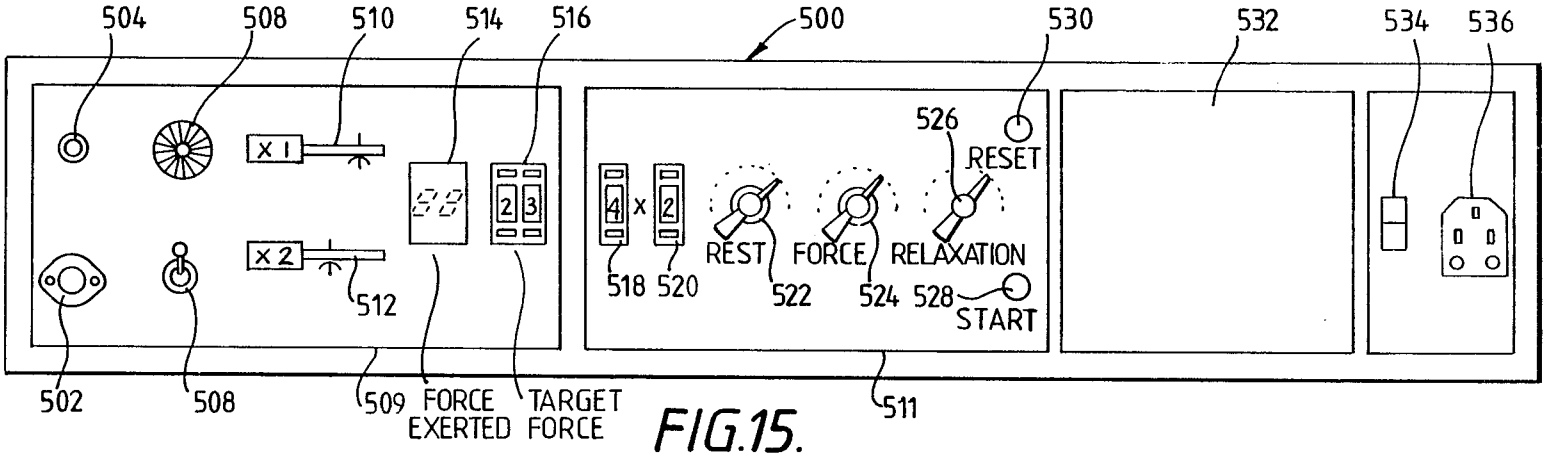
Figure 16:
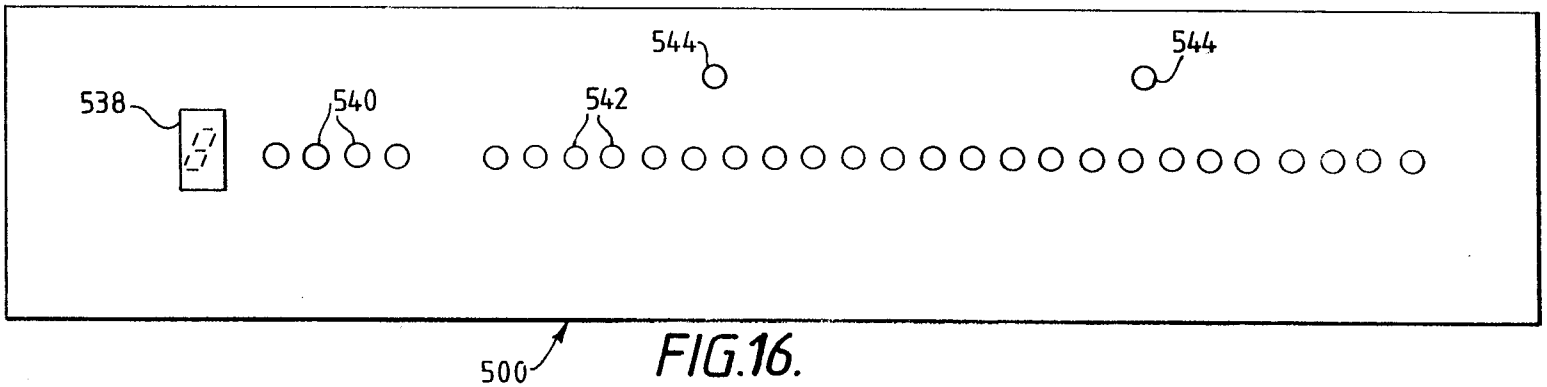
Figure 17:
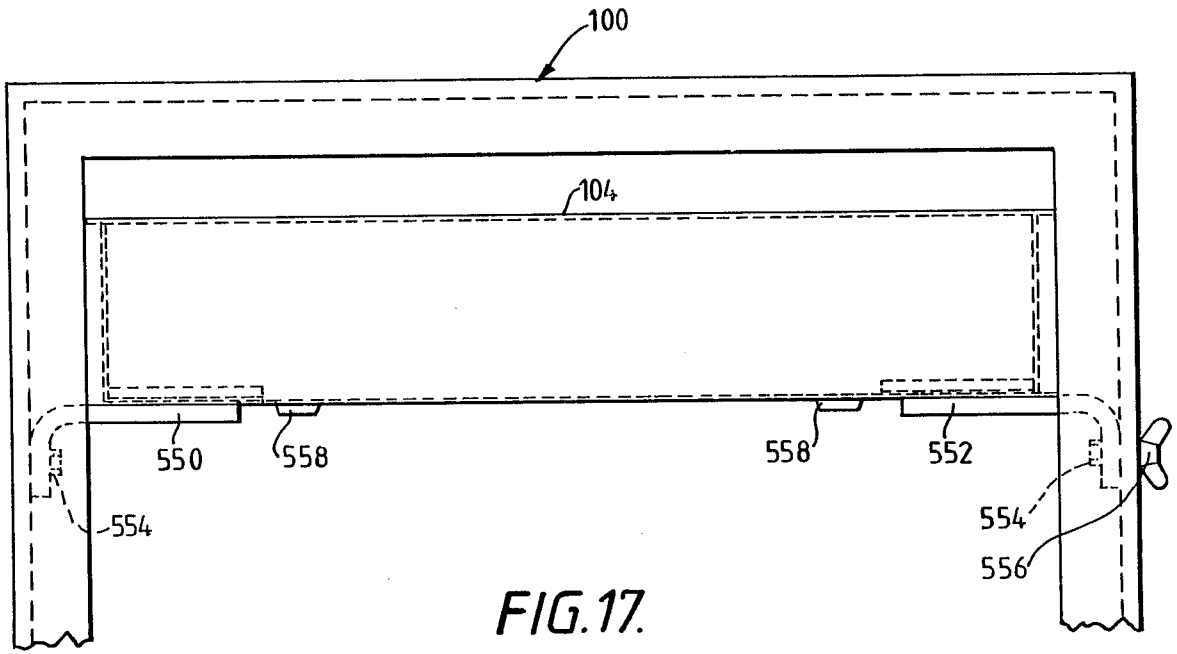
Figure 18:
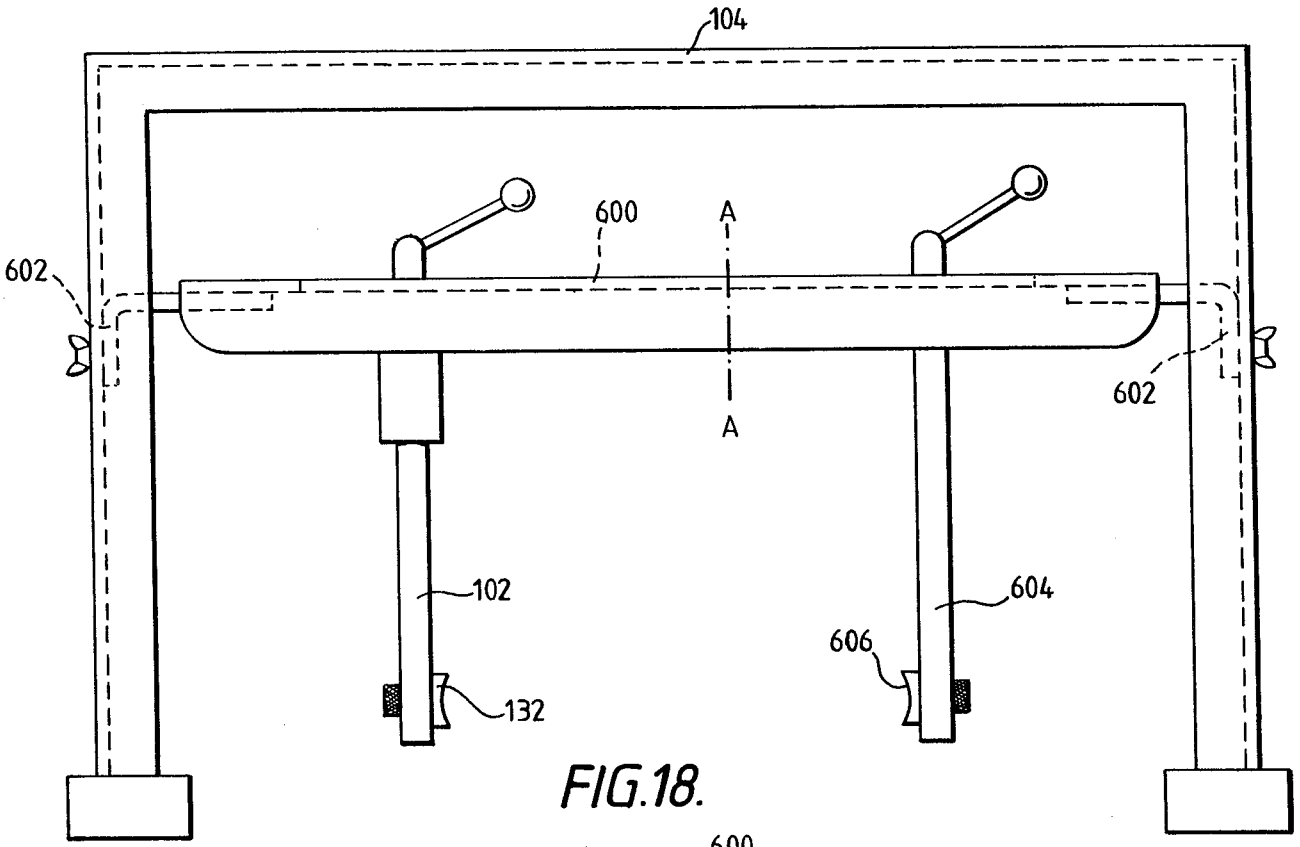
Figure 19:
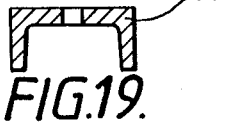

FIG. 10 is a schemmatic diagram of part of the electronic apparatus shown in FIG. 7, FIG. 11 is a block diagram of electronic control circuitry, FIG. 12 is a block diagram of electronic apparatus for indicating rest and force duration periods, FIG. 13 is a block diagram of electronic apparatus for sensing the strength of and counting the number of force applications in a physiotherapy exercise, FIG. 14 is a diagram showing wave forms appertaining to a sample programme, FIG. 15 is a view on the rear side of a modified form of electronic and display apparatus, FIG. 16 is a view on the front side of the apparatus shown in FIG. 15, FIG. 17 is a front view of part of a gantry showing a demountable control and display apparatus, FIG. 18 is a front view of a gantry with apparatus for abduction and adduction measuring and exercise, and FIG. 19 is a section on the line "A"-"A" in FIG. 18.

The particular apparatus illustrated in FIGS. 1 to 4 of the drawings is intended to provide a programable quadriceps exercising machine, but in addition, it provides a means of measuring the force of quadriceps isometric contractions. Moreover, the contraction force can be measured at any possible angle of "extension" of the patient's limb—using the expression "extension" to mean the angular relationship between the limb or part limb and the other parts of the body.

Furthermore, the illustrated apparatus is intended to be used by a patient sitting or lying on a bed or plinth—indicated in chain-dotted lines at 110 in FIG. 1—and more particularly for exercising the muscles of the lower limb, for example following an operation on the knee joint. However, the apparatus illustrated could be used in other forms of muscular therapy, where it is necessary to measure the voluntary contraction force exerted by the patient, or where it is necessary to control a physiotherapy programme with respect to measurement of the force exerted by a patient. Once the basic principles of the invention are understood from the description of this specific example, it should be possible to derive other forms of the invention to satisfy the requirements of other measurement or control techniques. It may however require the combined skills of the physiotherapist and the engineering designer to produce such further embodiments of the invention.

Essentially, the apparatus comprises a gantry 100 on to which can be secured a measuring beam 102 and an electronic control and display pack 104. The gantry itself comprises an inverted U-shaped frame mounted on feet 106, which are fitted with castors 108. The gantry contruction is adopted because in normal use, the patient will lie on a bed or plinth 110 within the gantry, the castors enabling the gantry to be moved easily over a bed or plinth. The three elements of the gantry, side supports and cross member are made of substantial rolled steel joists, so that it is of relatively massive construction.

Elongate slots 112 and 114 are formed respectively in the side supports and cross member of the gantry, these slots providing mountings for the measuring beam 102. As more clearly illustrated in FIG. 4, the measuring beam comprises a strain bar 116 and a tubular extension 118, which is secured on to a spigot 128 at the distal end of the strain bar. The tubular extension may be a press fit on the spigot or it may be shrunk on to the spigot or the spigot may be shrunk by spraying with liquid nitrogen and fitted into the end of the tube in the shrunk condition. At its proximal end, the strain bar 116 has a screw-threaded stud 120, which can be passed through one of the slots 112 and 114 in the gantry, and a domed nut 122 is provided which engages on the outwardly projecting part of the stud 120 for clamping the beam 102 to the side support or cross-member of the gantry as the case may be. It is possible therefore to mount the measuring beam 102 in a variety of locations. The beam is shown in full lines in FIG. 1 occupying a horizontal position extending part way across the gantry from the lefthand support member. Alternative positions extending horizontally from the righthand support member and vertically from the cross member are shown in FIG. 1 in chain-dotted lines. Besides the facility for location of the beam in these three attitudes, it will be appreciated that the elongate slots 112 and 114 allow considerable latitude in the exact positioning of the beam to meet the needs of a particular patient.

The strain bar 116 is a short metal bar (for example aluminium alloy) having a main cylindrical portion 124 an isthmus 126 and a spigot 128. The cylindrical portion 124 is clamped to the gantry, by the stud-and-nut just described, and the tubular extension 118 when secured on the spigot 128 forms an extension of the strain bar 116. The isthumus 126 is of the same width as a collar 120 at the inner end of the spigot 128, but it is of greatly reduced thickness. Hence, the second moment of area of the isthmus having regard to a force producing bending of the beam in a direction parallel with the thickness of the isthmus, is much less than the moment of inertia of other parts of the strain bar 116 or the tubular extension 118. In other words, the beam 102 is deliberately weakened against an applied bending moment at the position of the isthmus 126.

A cuff 132 is secured on the tubular extension 118 near to the distal end of the beam 102, the cuff having a concave undersurface 134, which may be padded, for engagement with the limb of the patient. The cuff is fastened on the extension 118 by a diametral pin 135 (with a screw-and-nut tightening device) which passes through a diametral hole 137 in the tubular extension 118. The entire beam can be turned about its own longitudinal axis to accommodate the cuff to a patient's limb, before the beam is locked on to the gantry by its locking nut. Thus it is possible to adjust the cuff so that it fits comfortably on the limb of the patient lying on the bed 110.

It is to be noted that the pin 135 is disposed at right angles to the width of the isthmus 126. This is important, because it ensures that any bending force applied by the patient to the beam through the cuff, tends to bend the beam in the direction which ensures maximum deflection of the isthmus. In other words, the construction of the beam concentrates any deflection brought about by pressure applied through a patient's limb, at the isthmus. Normally, the force which a patient can apply to the cuff 132 does not exceed 27 kilogrammes, so that it will be appreciated that the deflections of the beam are quite small, and these deflections will in any case be within the linear elastic limit of the isthmus, and will be imperceptible to the human eye. Of course, some force is transmitted through the beam to the gantry itself. However, the gantry is such a massive construction in relation to the force which can be applied by a patient through the beam, that any deflection of the gantry can be ignored. The fact that the deflection of the beam itself is imperceptible to the eye of the patient is a significant feature, because it means that for all practical purposes, and certainly for bio-feedback purposes, the apparatus can be said to operate without movement of the patient's limb. This is of especial importance in the case of a painful knee joint following a menisectomy-or an arthritic joint, where exercises involving isotonic exercises are virtually impossible.

Strain gauges (not shown) are fitted to the strain bar 116 in the region of the isthmus 126, to detect any deflection of the strain bar which occurs as a result of force applied to the measuring beam through the cuff 132. It will be appreciated that the strain gauges provide an accurate method of detecting deflection, especially as such deflection as does occur is concentrated in the region of the gauges. The output from the strain gauges appears as an analogue electrical voltage and because the deflection is in the linear elastic range of the beam 102, this signal is directly related to the pressure applied to the cuff 132. A metal shroud 140 fitted on to the strain bar 116 encloses the isthmus 126.

It will be appreciated that the measured deflection of the beam is directly proportioned to the force applied by the patient, since the entire deflection range is within the elastic limit of the material from which the isthmus is made. However a hole 139 is also provided part way along the tubular part 118 to provide an alternative mounting position for the cuff, and the location of this hole is such that positioning the cuff at this mid-location doubles the force which has to be exerted for a given deflection of the beam. Thus the apparatus is adapted to deal with a wider range of applied force than would be the case if the cuff had only a single location.

The machine described so far, ensures that the posture of the patient is well defined so that the assessment of muscular force is made at a fixed extension rather than by a measurement procedure in which th posture changes over a range of extension.

In some instances measures have to be taken to ensure that there is no movement of the gantry 100 on its castors 108 during an exercising programme. For this purpose, a restraint mechanism which is illustrated in FIGS. 5 and 6 is employed. Essentially, this restraint comprises a cross beam 400 which is intended to extend laterally of the plinth-such as the elevator type plinth 402) FIG. 5) or the conventional plinth 404 (FIG. 6). Tie bars 60 are pivoted on the ends of the cross beam 400 and extend forwarding from that beam. Near to their front ends, the tie bars pass through rotatable clamps 408 which are carried by mounts adjustable vertically along the length of slots 410 in the side columns of the gantry 100. Clamping nuts 412 are provided and these are arranged to clamp their respective mountings to the gantry in any selected vertical position as permitted by the length of the slots 410, and to clamp the tie rods in the clamps 408.

It will be appreciated that in the position illustrated in FIG. 5 or FIG. 6, it is not possible to push the gantry forwardly away from the foot of the plinth because of the engagement of the cross beam 400 behind part of the plinth.

The electronic pack 104 comprises a rectangular box within which all the electronic equipment is housed, and this box can conveniently be located under the cross member of the gantry (as indicated in FIG. 1) by screws passing through holes 142 in the cross member. The pack 104 includes a visual display intended to be observed by a patient and the location under the cross member facilitate this. However, this position is not possible if the measuring beam is mounted in the vertical position and in that case, the pack 104 is completely removed and placed adjacent to the bed 110.

The two faces of the pack 104 are shown respectively in FIGS. 7 and 8. It is intended that only the front face (FIG. 8) will be visible to the patient. The physiotherapist will of course be able to see both faces, and he operates on the rear face to set various parameters of an exercise programme as will hereinafter appear.

On the front face of the pack 104 there is a long line of light emitting diodes (L.E.D'S) 150 which comprise a so-called moving dot display, and this display is provided to give an indication of the strength of an applied force. In the specific example shown in the drawings, there are 33 L.E.D.'s in the force display line 150 and each of these gives an indication of approximately 1 pound applied force, so that a force of 1 pound applied to the cuff 132 of the measuring beam will produce illumination of the first (lefthand end) L.E.D. only; a 2 pounds applied force would cause illumination of the second L.E.D. only and so on; the entire display 150 therefore being able to deal with applied forces up to 33 pounds. (It will be understood that if the cuff 132 is positioned at the hole 130 then a force of 2 pounds would be required to illuminate the first L.E.D.; 4 pounds to illuminate the second L.E.D. and so on).

Moving dot displays are in themselves known, but an unusual feature of the force display 150 is the facility to cause a preselected one of the L.E.D.'s to flash on and off. The flashing L.E.D. provides a "target" force indication which the patient can see and by exerting pressure on the cuff 132, through voluntary construction of the muscles of the limb, the moving dot display can be activated in an attempt to produce illumination of the selected "target force" L.E.D. i.e. to cause the flashing L.E.D. to be steadily illuminated. The electronic arrangement which permits this flashing of a selected L.E.D. will be described hereinafter.

A pair of L.E.D.'s 152 is provided above the force display 150 and these are adapted to be illuminated in unison. They are arranged to illumine only when a target force is matched by an applied force and to be extinguished a predetermined period of time after the target force is achieved.

A series of four "rest duration" L.E.D.'s 154 is also provided on the front face of the pack 104. These are arranged to be illuminated sequentially, in equally timed steps, to provide an indication to the patient of the duration of a rest period in which he is required to allow the muscles being exercised to relax. The "count down" effect of the four L.E.D.'s also informs the patient when he is the rest period and helps him to exericse smoothly without the jerky reaction which could be expected if an "applied force" L.E.D. were to be illuminated without warning.

Finally, there is a single L.E.D. 156, referred to as the "end of sequence" L.E.D. because it is illuminated when an exercise programme has been completed, and remains so illuminated until a fresh exercise programme begins.

Turning now to the features found on the rear face of the electronic pack, these will be described for convenience from left to right.

At the lefthand end, there are jack plug connection points 160 for a chart recorder (not shown) which can be connected to the electronic pack for the purpose of producing a chart showing the performance of a patient during a test of maximum voluntary contraction or during a physiotherapy programme. The ability to produce a permanent hard record of this nature is something which has not been possible with the previous sand bag and Delorme boot methods of measurement and exercise.

At 162, there is shown a thumbwheel switch, which in this particular instance provides tens and units, for setting a target exercise force. Thumbwheel switches of this type, which are adapted to provide electrical output signals related to the selected numbers are well known. The target exercise force thumbwheel switch is also illustrated in FIG. 9. For the present, it is sufficient to say that the switch 162 can be set by the physiotherapist, to give a preselected target force for a physiotherapy programme.

Next there is another thumbwheel switch 164 similar to that at 162, but the switch 164 is used for setting the number of repetitions of the prescribed force in a given physiotherapy programme. This is followed by a "set zero" switch 166 after which, there is an illuminated display 168 which provides in arabic numeral form a visible indication of the force achieved by a patient pressing the limb being exercised against the cuff 132. All these items are provided on a lefthand panel 170 of the apparatus. In the centre of the electronic pack 104, there is a second panel 172 which is occupied by two rotary selector switches 174 and 176. The switch 174 is used by the physiotherapist to set the "rest duration" that is the length of the period during which the patient is required to relax the muscles which are being exercised between successive contractions of those muscles. It will be noted that the selector switch 174 is also illustrated in FIG. 12, and that its range of positions follows a binary sequence. The selector switch 176 is the "force duration" switch and is also illustrated in FIG. 12. Furthermore, its range of positions also follows a binary sequence. The force duration switch is used by the physiotherapist to set the period of time during which the patient is required to exercise a muscular force against the cuff 132 of the apparatus. Finally, on the central panel 172, there are RESET and START push-buttons 178 and 180 which are shown in FIG. 11.

Towards the righthand end of the electronic pack 104, there is an a.c. mains control panel 182 which includes a main on/off switch 184 for the apparatus, a fuse 186, and a socket 188 for a mains plug.

Before describing the method of operation, reference will be made to FIGS. 9 to 14, which illustrate the electronic circuitry, in some cases in block diagram form.

FIG. 9 shows the circuitry required to actuate the moving dot force display 150, which it will be recalled, is visible to the patient on the front side of the electronic pack 104. It will be seen that the analogue signal received from the strain gauges, and comprising a voltage which equals a constant multiplied by the force applied at the cuff 132, is first fed to a zero adjustor 200 which is a known device, used to ensure that there is no output signal from the apparatus, when zero force applied to the transducer by the patient. From the zero adjuster, the signal passes through an amplifier 202 to an analogue to digital converter 204. Analogue to digital converters are again in themselves well known, and it should be mentioned, that this particular converter gives a binary coded decimal output (B.C.D.). The B.C.D. output appears at the right output lines indicated in two groupings on FIG. 9, that is to say the M.S.B. group comprising the lines $D^i$s, $C^i$s, $B^i$s and $A^i$s and the L.S.B. group comprising the lines Ds, Cs, Bs and As. Each of the two groups of output lines from the digital converter 204 has a tapping 12$^i$, 12 respectively, to M.S.B. and L.S.B. code comparators illustrated in FIG. 13.

Reverting to FIG. 9, there are also tappings from the M.S.B. and L.S.B. groups of lines to B.C.D. to seven segment decoders 206 the output of which provides the visual signal 168 shown in FIG. 7 for indicating the force achieved by the patient. It will be appreciated, that since the analogue signal is directly proportional to the force applied by the patient to the cuff 132, then the B.C.D. output from the analogue to digital converter 204 is equally directly proportional to the applied force, and it is this output, which gives rise to the indication at the visual indicator 168. Therefore, the physiotherapist has a visual indication in arabric numeral form of the force which is achieved by the patient, and this can be used initially for the purpose of measuring the maximum voluntary contraction force of the patient.

The M.S.B. and L.S.B. lines from the analogue to digital converter 204 provide part of the input indicated at 14 in FIG. 9, to a multiplexer 208. The multiplexer is illustrated in detail in FIG. 10, but before passing to that figure, reference is made to the righthand side of FIG. 9, and in particular to the target force thumbwheel switch 162, which also provides M.S.B. and L.S.B. output lines $D^i$t, $C^i$t, $B^i$t and $A^i$t, and L.S.B. lines Dt, Ct, Bt and At. Tappings 13 and 13$^i$ are taken respectively from the L.S.B. and M.S.B. lines to the L.S.B. and M.S.B. code comparators illustrated in FIG. 13. However, the M.S.B. and L.S.B. lines from the target force thumbwheel switch 162 provide the other part of the input to the multiplexer 208.

Referring now to FIG. 10, it will be seen that there are three sets of integrated circuits 210, 212 and 214. Each of these integrated circuits comprises four AND gates 216, 218, 220 and 222, and two NOR gates 224,226. A clock (not shown) provides pulses at say 2000 cycles per second to a flip-flop commutator 228, which provides the operating signal for the moving dot matrix 150, insofar as that matrix is used to indicate the applied force. It will be appreciated, that when any particular L.E.D. is illuminated with a supply voltage at 1000 cycles per second, persistance of vision gives the L.E.D. the appearance of continual illumination.

Another clock (not shown) provides clock pulses at a "flicker" frequency at the input 230. The flicker clock pulses may be at two or four cycles per second, so that if these are used to provide the operating voltage for one of the L.E.D.'s of the matrix 150, then that L.E.D. will appear to be flashing to an observer.

The Q output of the commutator 228 provides one input to each of the AND gates 218 and 222 of each of the integrated circuits 210, 212 and 214. In the case of the integrated circuit 210, the other inputs to the AND gates 218 and 222 are provided by the outputs $B^i$s and $A^i$s from the M.S.B. of the analogue to digital converter 204. On the other hand, the other inputs to the AND gates 218 and 222 of the integrated circuits 212 and 214 are provided by the outputs Ds, Cs, Bs and As of the analogue to digital converter 204. Consequently, the only AND gate 218 or 212 of the integrated circuits 212 and 214 which will give an output signal is that which corresponds to the active input As, Bs, Cs or Ds corresponding to the L.S.B. of the output from the converter 204. Likewise, only one of the AND gates 218 and 222 of the integrated circuit 210 will give an output signal, and that corresponds to whichever of the M.S.B. lines of the converter 204 is active.

The $\overline{Q}$ output of the flip-flop commutator 228 forms one of the inputs to an AND gate 232, so that signals are only applied to the AND gate 232 from the commutator 228 alternating with the signals through the Q output. The AND gate 232 will therefore only produce an output at the "flicker" frequency, within the "off" periods of the output at the Q terminal of the commutator 228. This provides a simple way of multiplexing whereby two completely independent signals can be applied to the same equipment.

The output from the AND gate 232 provides one of the inputs to each of the AND gates 216 and 220 of each integrated circuit 210, 212 and 214 and the other inputs to these AND gates are provided by the $B^i$t, $A^i$t; Dt; Ct; Bt and At outputs from the target force thumbwheel switch 162. Consequently, only those AND gates 216 and 220 which correspond to the live input lines from the target force thumbwheel switch will be activated.

The outputs from the AND gates 216 and 218 are taken to a NOR gate 224, the output from which if taken through one of a series of inverters at 234 to give output signals A, B. C. D. $A^8$ and $B^i$ grouped into outputs 16 and 16$^i$ from the multiplexer 208. These outputs 16 and 16$^i$ become the inputs respectively to a B.C.D. to 1 in 10 decoder 236 and a B.C.D. to 1 in 10 decoder 238. The digit output lines 0 to 9 from the decoder 236 are taken to the four ranks of L.E.D.'s in the matrix 150, and the four tens lines 0, 10, 20 and 30 from the decoder 238 pass through a buffer amplifier 240 and then to the four files of the matrix 150. The manner in which the inputs to the matrix are operated in order to cause illumination of a single L.E.D. at any one time is well known and needs no further description. It will be appreciated however, that with the arrangement illustrated in FIGS. 9 and 10, at any one time during operation, there will in fact be two L.E.D.'s illuminated alternately, although one of them will be illuminated at 500 cycles per second, and will therefore appear to be continuously illuminated, whereas the other one will appear to be flashing because it receives its input signal at the flicker frequency from the input 230.

By adjusting the target force thumbwheel switch 162, it is possible to select one of the 33 L.E.D.'s for flashing illumination. This will correspond to a preselected target load. As the patient presses his limb against the cuff 132 and exerts a force by contracting his muscles on the cuff, the resulting deflection of the beam 102 produces the analogue signal fed to the converter 204 and this indicates the force achieved by the patient at the visual display 168 (which the patient himself cannot see, but which is visible to the physiotherapist) and causes successive illumination of the L.E.D.'s of the moving dot display 150 up to the L.E.D. which corresponds to the maximum achieved force. The objective of the patient will be to cause the illumination of that L.E.D. which is flashing as an indication of the target force to show that he has actually achieved the target force. A moving dot display is of course readily appreciated, by a patient, because besides indicating whether or not the target force has been achieved, it also gives an indication of the proportion of the target force which is achieved—should the patient not be able to achieve the full target force—and the speed of operation of the moving dot display also gives an indication of the ability of the patient to achieve a target force in a given time.

The control circuit for the electronic equipment is shown in FIG. 11, and it employs a series of latches and monostable switches. Working from top to bottom in FIG. 9, there is a clock latch A; a monostable switch $\alpha$; a monostable switch $\beta$; a force latch B; a monostable $\gamma$; a target latch C; a monostable $\delta$; a system reset latch D and a monostable $\epsilon$. There are also AND gates A1, A2, A3, A4 and A5. The manner in which these latches, switches and AND gates function will become apparent from the description hereinafter of the method of operation of the electronic system.

Turning to FIG. 13, it has already been noted that there are code comparators 250 and 252. These comparators compare the binary coded decimal signal from the analogue to ditigal converter (outputs 12 and 12$^i$ in FIG. 9) with the binary coded decimal signal from the target force thumbwheel switch (outputs 13 and 13$^i$ in FIG. 9), and an output signal is issued on the line 10 only when the target force selected by the target force thumbwheel switch is equalled by the achieved force. In other words, an output signal occurs at 10, when the patient achieves the target force by pressure against the cuff 132.

FIG. 13 also illustrates a preset count down counter comprising an L.S.B. 254 and and M.S.B. 256. The thumbwheel switch 164 which is used for setting the number of force repetitions required by the physiotherapist for a particular exercise programme appears as a binary coded decimal signal along lines fed into the L.S.B. and M.S.B. sections of the count down counter, so that initially, the counter is set to the selected number. At 9, there is an input to the count down counter, and whenever a signal is received at 9, the count down counter indexes down by one digit. An input 1 to the count down counter provides a load command, for causing the output from the thumbwheel switch 164 to be fed into the countdown counter. From the L.S.B. 254 of the counter, there is an output signal 11, and from the M.S.B. 256 of the counter, there is an output 11$^i$. Whenever either of the two parts of the count down counter arrives at a zero, a signal occurs on the output 11 or 11$^i$. An output signal on both these lines will indicate that the counter has counted down from a loaded input number, to numerical zero.

If the apparatus is to be used simply to measure the maximum voluntary contraction of a patient, then there is no need to set a target force by using the thumbwheel switch 162. Instead, the patient simply presses the limb which is being tested against the cuff 132 and exerts as much force as possible on the beam 102. The achieved force will appear at the visual display 168, and will also appear on the moving dot display 150, and the physiotherapist can simply a note of the number. This is all that is required to measure the maximum voluntary contraction, and it contrasts with the relatively complex iterative or trial-and-error system using applied weights in sand bags or attached to a Delomme boot.

When the apparatus is to be used for an exercising programme, the object of the control circuit is to ensure that the programme set by the therapist and stored on the various dials of the control panel, are conveyed in the correct order to the patient by means of the indications on the display panel which is visible on the front face of the electronic pack 104.

The list of variables which may be programmed to set levels is as follows:

TARGET FORCE set on the target force thumbwheel switch 162 and exercising control over the flashing L.E.D. of the moving dot display 150.

REPETITIONS (of applied force)—set on the thumbwheel switch 164, and providing an input signal for the preset count down counter 254 and 256.

REST DURATION—set on the rotary selector switch 174 in terms of number of seconds rest, and controlling the four L.E.D.'s 154 which are arranged to be illuminated successively at equal time intervals.

FORCE DURATION—set on the rotary selector switch 176 in terms of a time during which the force has to be exerted by the patient, and controlling the operation of the L.E.D.'s 152.

During the execution of an exercise programme, the control circuit, in all but the shortest programme, assumes five different states, always in the same order. The duration of each separate state in maintained by the specific "settings" and "re-settings" of the four latches A, B, C and D (FIG. 11). A change of state involves the setting the re-setting of the latches. The five different states are identified as follows:

STATE 1—manual reset (or standby).

STATE 2—start (or first rest duration).

STATE 3—first and subsequent force durations (excepting last).

STATE 4—second and subsequent rest durations.

STATE 5—last force duration and system reset (or standby).

States 1, 2 and 5 appear once only in every programme. The minimum programme in which only one force application is programmed would have the following states: 1, 2 and 5. A programme with two force repetitions would have the following states: 1, 2, 3, 4 and 5. A programme with three force repetitions would have the following states: 1, 2, 3, 4, 3, 4, and 5. It will be appreciate, that for larger numbers of force repetitions, the states 3 and 4 will be repeated an appropriate number of times between the states 2 and 5.

The control circuit performance during execution of a five state programme will now be described in some detail.

STATE 1 (manual reset).

This state, in which all four latches A, B, C and D are set to logical "O" at the Q terminals is achieved at the instant that the RESET button on the control panel is operated. The reset button is indicated at 178 in FIG. 11. This is the standby state in which the following conditions exist by virtue of the latch settings:

(i) the END OF EXERCISE ROUTINE indicator 156 at the extreme left of the patient's display panel (FIG. 8) will be activated to indicate the standby state of readiness of the system. The indicator 156 receives its actuating signal from the Q terminal of the clock latch A on the line 2.

(ii) the 8-bit binary counter gate 300 (FIG. 12) will be closed, thus preventing clock pulses from entering the counter. The control of the binary counter 300 is execised on the line 3 from the Q terminal of the clock latch A.

(iii) The demultiplexer 208 will be disabled, thus deactivating the REST DURATION displays 154. Deactivation of the multiplexer is achieved by the output at 4 from the Q terminal of the clock latch A, and the output $4^i$ from the Q terminal of the force latch B.

(iv) The 8-bit binary counter 300 will be reset to 0 by the output signal at 5 from the monostable switch $\alpha$.

(v) The FORCE DURATION display 152 will be deactivated, under the control of an output signal 8 from the $\overline{Q}$ terminal of the force latch B.

(vi) The TARGET SUCCESS latch C, and the SYSTEM RESET latch D, will be reset in a state of readiness for future involvement.

The MANUAL RESET state, is that which will normally exist, when a patient is about to begin an exercising programme.

STATE 2. (START: FIRST REST DURATION)

The exercise routine or sequence, is started by operating the START button 180 on the control panel, as a result of which, the clock latch A is set so that the Q terminal assumes logical "1" and as a result, the following occur:

(i) The programmed number of force REPETITIONS, set on the thumbwheel switch 164 is loaded into the count down counter 254 and 256, as a preset count by the signal which appears at 1 (FIGS. 11 and 13).

(ii) The END OF EXERCISE ROUTINE indicator 156 is deactivated, so that this L.E.D. goes out. This is achieved by the signal which occurs at the line 2 (FIGS. 5 and 13).

(iii) The 8-bit binary counter 300 has its gate opened by the output signal 3 from the clock latch A, permitting clock pulses to enter the 8-bit binary counter.

(iv) The demultiplexer 208 is enabled by a change of level on the output line 4 from the Q terminal of the clock latch A, thus allowing the REST DURATION indicators 154 to operate in sequence for a duration determined by the setting of the rotary selector switch 174 on the control panel.

Thus, from the point of view of the patient, once the START button is pressed, the end of exercise routine lamp is extinguished, and the first REST DURATION lamp 154 is illuminated. The REST DURATION lamps are then illuminated successively, in accordance with the time settings of the rotary switch 174, to give an effective "count down" of the rest duration period for the patient. The patient is of course aware that when the FORCE DURATION lamps 152 are illuminated, he has to contract the muscles of the limb in order to exercise it, and if possible to achieve the preselected target force. However, the "count down" of the REST DURATION lamps 154 is very useful to the patient in indicating to him where he is in the REST DURATION period, and when he can expect the FORCE DURATION lamps to be illuminated. This mitigates the danger of the patient jerking the affected limb when attempting to achieve the target force, as soon as the FORCE DURATION lamps 152 are illuminated.

STATE 3. (First and subsequent force durations).

Referring to the timing illustration in FIG. 14, it will be seen, that the last quarter-period pulse from the demultiplexer 302 (FIG. 12) has a rising edge, Tr on the interface between states 2 and 3. This rising edge on the line 6 from the demultiplexer 302 initiates STATE 3 by triggering the monostable switch $\beta$. The output from the monostable $\beta$ resets the 8-bit binary counter 300 by sending a signal through the monostable switch $\alpha$ which appears as an output at 5 fed as an input to the reset of the 8-bit binary counter 300. Another output from the monostable switch $\beta$ sets the force latch B, to produce the following state of affairs.

(i) the logical "0" level of the $\overline{Q}$ terminal of the force latch B causes the FORCE DURATION indicators 152 to be activated by issuing a signal at 8, which passes through the amplifiers 304 (FIG. 12) to the L.E.D.'s 152. The FORCE DURATION indicators 152 will then remain activated, until the force latch B is reset at the start of STATE 4. This is indicated in the diagram which forms FIG. 14. It should be noticed that the logical "1" level of the Q terminal of the force latch B switches off the demultiplexer 302 for the duration of STATE 3, and thus prevents activation of the REST DURATION indicators 154 at the same time as the FORCE DURATION indicators 152.

(ii) The AND gate A5 is opened by the logical "1" level of the Q terminal of the force latch B, but only for the duration of the FORCE DURATION state. The consequence of this is that if the patient exerts a force which equals or exceeds the set target force within the FORCE DURATION state only, a pulse generated on line 10 from the code comparator 250 and 252, is transmitted through the gate A5 and this will set the target latch C. The resulting level change at the Q terminal of the target latch C will trigger the monostable switch $\delta$ which in turn will generate a clock pulse on the line 9 to the count down counter 254 and 256. The latter will thus be decremented by a count of 1 from the original set number. It is impossible for the patient to gain credit for achieving the target force more than once within the same FORCE DURATION period, because the target latch C will not respond to more than one pulse at its set terminal S without alternate RESETS.

It is during the FORCE DURATIONstate, that the patient has to exert pressure against the beam 102, in order to attempt to achieve the target force. The manner in which the patient receives an indication of his achievement on the moving dot display 150 during this muscular contraction has already been explained.

STATE 4. (Second and subsequent rest durations).

The distinction between the first and second rest durations is that the first is initiated by operating the START button 180, whereas the second and subsequent rest durations are initiated by the rising edge, Tf of the pulse on the line 7 from the 8-bit binary counter 300. This edge occurs on the interface between states 3 and 4 as indicated in FIG. 14. This rising edge, transmitted through the AND gate A1 triggers the monostable switch $\gamma$, which in turn generates a pulse which is steared by the AND gate A3 to reset the 8-bit binary counter, and the latches B and C only. This produces the following results:

(i) The target latch C is reset in readiness to allow one clock pulse to be transmitted to the count down counter 254, 256, within the next FORCE DURATION state.

(ii) The resetting of the force latch B causes its Q terminal to assume logical "0" with the result that the AND gate A5 is blocked, thus preventing any pulses from the code comparator 250,252, becoming count down clock pulses. Finally, the lower level of the Q output from the force latch B enables the demultiplexer 302 to activate the REST DURATION indicators 154.

From the point of view of the patient therefore, at the end of the FORCE DURATION period, the force duration indicators 152 are extinguished, and the rest duration indicators 154 begin to perform their "count down" sequence to indicate that he should relax the limb, but be in readiness to begin the next contraction.

STATE 5. (Last force duration and system reset).

Within this state, the count down counter 254,256 will assume O count. This of course occurs when the full programme set by the physiotherapist has been carried out. The count down counter 254,256 marks this event by providing a pulse at the outputs 11,11$^i$ which sets the SYSTEM RESET latch D. This has the effect of closing the AND gate A3, and opening AND gate A2, with the consequence, that when the pulse which defines the end of the final force duration is generated by the monostable $\epsilon$, it is gated by the AND gate A2, rather than by the AND gate A3. It can be seen from Figure that this re-routed pulse provides a complete system reset, because it is fed through a NOR gate 306 and an inverter 308 to the gates controlling the inputs to all the latches and monostable switches excepting the clock latch A. Since the clock latch A is then reset, the END OF EXERCISE ROUTINE indicator 156 is illuminated to indicate to the patient that the system is once again on standby. In some clinics, it is the practice to exercise the uninjured limb along with the injured limb. The apparatus described above, could be adapted to suit this practice, by extension of the TARGET FORCE programming facilities to both limbs, and, in addition, by the provision of another indicator, to signal to the patient when to change the limbs which are to be exercised.

It is also the practice to define an exercise routine as a number of muscular contractions at a particular target force. However, during an exercise session in a clinic, the patient may be asked to repeat the exercise routine a number of times with adequate rest periods between the routines. It will be appreciated, that in order to meet this requirement, it would be possible to modify the apparatus, so that a number of routines or exercise programmes could be preprogrammed into the electronic controls, and the time length of the rest periods between routines could also be preprogrammed.

In FIGS. 15 and 16 there is illustrated an alternative form of control and display box 500 which can be used instead of the box 104 shown in FIGS. 1, 7 and 8. Taking the display panel shown in FIG. 15, which is on the side of the apparatus visible to the physiotherapist, but not to the patient, and working from left to right:

At the lefthand end, there is a panel 509 which contains the controls and displays appertaining to the basic setting of the apparatus on the phsyiotherapist's assessment of a patient. At the extreme lefthand end, there is a socket 502 to receive the cable input from the transducer (strain gauge) and above it, there is an output socket 504 providing an output for an analogue chart.

At 506 there is a switch which enables the operator to blank out the display on the opposite side of the box 500, that is the display which is visible to the patient. Above that, there is an analogue zero set knob 508.

Then there are two diagrammatic representations of the beam and cuff arrangement, illustrating the two possible positions of the cuff, that at 510 being the end position where the cuff is attached using the hole 137 in the tubular part 118 of the beam, and that illustrated at 512 being the position when the cuff is located in the hole 139. The representation 510 bears the symbol "X1" indicating that the various force readings are to be multiplied by a factor of 1, and the representation 512 bears the inscription "X2" indicating that the force readings and settings are to be multiplied by a factor of 2. Each of the representations 510 and 512 may be adapted for illumination, in response to a detector sensing the presence of the cuff at one of the two positions on the beam, so that the illuminated representation gives the operator an immediate indication of the multiplication factor.

At 514 there is a seven segment numerical display indicating the force exerted by the patent, and this therefore is equivalent to the display 168 in FIG. 7. At 516 there are push button switches and a numerical display providing the target force setting arrangement for the apparatus.

The panel 511 which is in the centre of the box 500 contains certain setting equipment which has to be used when the apparatus is pre-programmed for an exercise regime. At 518 there are push button switches and a numerical indication of the number of force repetitions required for a particular sequence, and at 520 there is a similar arrangement which can be used to set the number of sequences in an exercising regime. At 522 there is the manually adjustable rest duration switch, which is similar to that illustrated at 174, and at 524, there is a similar manually adjutable force duration setting switch similar to the switch 176. In this construction however, there is a third manually adjustable switch 526, of similar type to those at 522 and 544, but which can be set to give a longer period of relaxation between varius exercise sequences. It will be appreciated, that by using this switch in conjunction with the number of sequences switches at 520, it is possible to programme a long exercising regime, comprising a number of sequences of exercies separated by relatively long relaxation periods. This provides the facility for the physiotherapist to programme a regime which may take 2 or 3 hours, a large part of which will comprise relaxation periods. At 528 there is a start button controlling the starting of the exercise regime programme, and at 530 there is a re-set button, controlling the re-setting of all the programme which can be set using the switches available on the panel 511.

The panel 532 will normally be blank, but provides a space for the possible insertion of a dot matrix printer which can be used to give a graphical record of the analogue chart produced by the output from the recorder socket 504.

Finally, at the righthand end of the display, there is a mains control on/off switch 534, and the socket 536 for the mains input.

Turning now to FIG. 16, the arrangment is very similar to that shown in FIG. 8, in that there is a set of rest duration lamps 540 and a set of lamps 542 which provide a moving dot display of force and a target force indicator. In addition, there are lamps 544 giving an indication of force duration, and functioning exactly as the lamps 152 illustrated in FIG. 8.

At 538, there is a seven bit display providing a count-down for the number of sequences. When the physiotherapist sets the number of sequences using the switches at 520, the appropriate number will be displayed at 538. Each time the patient completes one of the pre-programmed sequences, the number displayed at 538 will reduce, and when zero is displayed, the patient knows that he has come to the end of the exercising regime.

FIG. 17 illustrates a method of mounting the control and display box 104 or 500. The top part of the gantry is illustrated, and the box 104 is secured by screws and thumb nuts to a pair of angle brackets 550 and 552, one at each end. Each of these angle brackets can be secured in position on the gantry, by means of set-screws 544, passing through holes in the vertical columns of the gantry, there being wing nuts 556 for locking the angle brackets 550 and 552 to the gantry. A set of rubber feet 558 is secured to the underside of the display box 104. By slackening the thumb nuts it is possible to demount the box 104 from the brackets, and it can then be stood on its feet 558 at a position remote from the patient if required.

FIGS. 18 and 19 illustrated an arrangement which is used with gantry 104, when it is necessary to provide for abduction and adduction therapy.

A channel section support beam 600 is provided at its ends with angle brackets 602, whereby the support beams 600 can be attached to the gantry in the position shown in much the same way as the control box 104 is attached as described with reference to FIG. 17. The beam 102 with the cuff 132 is then attached to the support beam 600, so that the beam extends vertically downwards, as illustrated in FIG. 18. It will be appreciated, that the transducer arrangement is the same as that described with reference to FIGS. 1 to 4, and there is no need to describe the construction of the beam 102 in detail, because it is in fact the same beam as that illustrated in FIG. 4 simply mounted in a different position. Because of the location of the support beam 600, it may not be possible to have the control and display box 104 in the position illustrated in FIG. 1, and consequently that box may have to be removed and mounted separately as has been described. The provision of the beam 102 in the position illustrated in FIG. 18 allows the patient to exert sideways pressure through one of his lower limbs to the beam 102.

FIG. 18 also illustrates a reaction beam 604, which is simply a rigid bar or tube adapted to be attached to the support beam 600 in similar fashion to the beam 102, and having a cuff 606. However, the reaction beam 604 does not have the portion of reduced moment of inertia, nor is it provided with strain gauges or other transducers, since no measurements are taken from the reaction beam. It simply provides a means whereby a patient can for example position one leg against the cuff 606 and the other against the cuff 132 for carrying out an abduction exercise.

It may be necessary to provide fo protection of the apparatus against the exertion of an exceptionally large force by the patient. This could arise for instance if the patient uses a strong limb to exert pressure through the cuff 132 on the beam 102. For this purpose therefore, an audible alarm system may be built into the control box, and adapted to be activated, if the measured force exerted exceeds a threshold indicating that the exerted force is out of the range of the apparatus at its particular setting.

I claim:

1. Programmable isometric exercising apparatus comprising: resistance means for resisting a force applied by a patient contracting muscles associated with a limb or body part pressed against the resistance means and a pre-set graphic display rest duration indication means, said rest duration indication means being adapted to issue a "count-down" signal up to a predetermined starting time at which the patient is required to exert force against said resistance means the said limb or body part being pressed against said resistance means without significant movement of motion.

2. Programmable isometric exercising apparatus according to claim 1, wherein said rest duration indication means comprises a series of lamps adapted to be illuminated or extinguished in series to provide the "count-down" signal.

3. Programmable isometric exercising apparatus comprising: resistance means for resisting a force applied by a patient contracting muscles associated with a limb or body part pressed against the resistance means, and a calibrated graphic display device adapted to give an indication of the force applied against said resistance means, means for displaying a pre-setable target force within said graphic display and the said limb or body part being pressed against said resistance means without significant movement or motion, wherein said graphic display comprises a series of indicia each corresponding to a predetermined applied force the value of the predetermined preselected force increasing along the series so that as the applied force is increased through the range of said preselected forces, said indicia are successively activated and deactivated along the length of the series.

4. Exercising apparatus according to claim 3, wherein said indicia are lamps arranged and controlled to provide a moving dot display, so that, in use, one lamp of the series is activated separately to represent the instant value of the applied force by virtue of the position of the activated lamp with respect to the series of lamps as a whole, any one of which said lamps is capable of activation to indicate the target force.

5. Exercising apparatus according to claim 4, wherein there are manually operable means activating a selected indicia to give an indication of a target applied force corresponding to the force required to cause activation of that indicia.

6. Exercising apparatus as claimed in claim 3, wherein there are means for preselecting a number of repetitions, the arrangement being such that the number of repetitions reduces by one each time the applied force at least equals the preselected target force and indicator means for indicating to the patient when the count-down reaches zero.

* * * * *